US005384988A

United States Patent [19]

Hernandez

[11] Patent Number: 5,384,988

[45] Date of Patent: Jan. 31, 1995

[54] LENS SURFACING ASSEMBLY

[75] Inventor: William D. Hernandez, Tarpon Springs, Fla.

[73] Assignee: Practical Systems, Inc., Tarpon Springs, Fla.

[21] Appl. No.: 14,393

[22] Filed: Feb. 5, 1993

[51] Int. Cl.[6] ..... B24B 13/02

[52] U.S. Cl. ..... 451/42; 451/538

[58] Field of Search ..... 51/DIG. 34, 401, 406, 51/394, 284 R, 326

[56] References Cited

U.S. PATENT DOCUMENTS

| | | | |
|---|---|---|---|
| 81,986 | 9/1868 | Crane . | |
| 2,752,738 | 7/1956 | Seifert | 51/DIG. 34 |
| 3,144,737 | 8/1964 | Faas | 51/185 |
| 3,785,094 | 1/1974 | Holzhauer | 51/401 |
| 3,959,935 | 6/1976 | Stoppacher | 51/395 |
| 4,274,232 | 6/1981 | Wylde | 51/406 |
| 4,288,233 | 9/1981 | Wiand | 51/295 |
| 4,558,542 | 12/1985 | Marton | 51/401 |
| 4,732,502 | 3/1988 | Braun | 51/406 |
| 4,788,798 | 12/1988 | DeFranco et al. | 51/406 |
| 4,962,618 | 10/1990 | Wylde | 51/395 |
| 5,095,660 | 3/1992 | Dillon | 51/58 |

FOREIGN PATENT DOCUMENTS 2039810 8/1980 United Kingdom ..... 51/DIG. 34

*Primary Examiner*—Robert A. Rose

*Attorney, Agent, or Firm*—Pettis & McDonald

[57] ABSTRACT

The current invention relates to a lens surfacing assembly and a method for grinding and polishing glass or plastic optical lenses. The assembly is primarily intended for use with a rigid lapping tool and a typical lens grinding machine. The lens surfacing assembly comprises a strippable adhesive member that is attached to the lapping tool for use throughout the grinding and polishing operation for attachment of a reversible, double sided lens surfacing pad having a coarse surface on one side and a fine surface on the other. After the grinding has been completed, the reversible pad is removed and a polishing cloth is attached to the adhesive member. The combined thickness of the pad and the adhesive member is equal to the compensation designed into the radius of curvature of the lapping tool arcuate surface. The combined thickness of the polishing cloth and the adhesive member is also equal to the compensation designed into the lapping tool.

26 Claims, 2 Drawing Sheets

LENS SURFACING ASSEMBLY

BACKGROUND OF THE INVENTION

1. Field of the Invention

The present invention relates to a lens surfacing assembly and a method for grinding and polishing glass or plastic optical lenses. The assembly is primarily intended for use with a rigid lapping tool having an arcuate surface that is configured generally to the shape of the finished lenses. The radius of curvature of the arcuate surface is reduced by a standard compensation that equals the thickness of an adhesive member plus a double sided surfacing pad or the thickness of the adhesive member plus a polishing cloth.

2. Description of the Prior Art

Pads with abrasive mediums thereon are well known in the art. U.S. Pat. No. 81,986, issued to J. H. Crane discloses a flexible abrader which comprises a central layer or web of flexible material that is surfaced on both faces with suitable abrading material. The patent to Holzhauer, U.S. Pat. No. 3,785,094, discloses a synthetic resin impregnated fiberglass man having a layer of abrasive grains attached to both surfaces of the mat.

A number of other U.S. patents; in particular, U.S. Pat. No. 3,144,737, issued to K. D. Faas; U.S. Pat. No. 3,959,935, issued to W. Stoppacher; U.S. Pat. No. 4,288,233, issued to R. C. Wiand; and U.S. Pat. No. 4,962,618, issued to S. J. Wylde, each disclose a single sided pad made from various materials, one side having an abrasive material and the opposing side an adhesive for attaching the pad to a lapping tool. U.S. Pat. No. 4,788,798, issued to DeFranco, et al., discloses a lens polishing pad having one side with an abrasive surface and the other side with a strippable adhesive for removable attachment to a lapping tool.

The current apparatus and process for rough grinding, fine grinding, and polishing optical lenses require three separate pads with adhesive attached thereto. Lapping tools are designed to have a predetermined radius of curvature so its radius of curvature plus the thickness of the coarse pad and the thickness of the finishing pad equal the final radius of curvature of the finished lens. This reduction in the standard lapping tool's radius of curvature is 0.018 inches and is called the standard compensation. The lapping tool, with the coarse pad attached, and a lens blank, having the appropriate radius of curvature cut therein, are mounted within a lens surfacing machine. The lens is roughly ground to a radius of curvature equaling the radius of curvature of the lapping tool plus the thickness of the lens surfacing pad. The curvature of the lens blank now differs substantially from the final desired curvature. The center of the lens is close to the final desired curvature, but the peripheral area of the lens has much material to be removed due to the shorter radius of curvature when only the coarse pad is attached to the lapping tool. A second lens surfacing pad with a finer abrasive is now attached to the lapping tool so that it overlies the existing coarse pad, and thus, increasing the radius of curvature by the additional thickness of the fine pad. This total radius is the desired radius for the finished optical lens. However, as the radius of the coarse pad is an incorrect radius, when the fine pad is used to grind the lens, the fine pad must not only remove the scratches caused by the coarse pad, the fine pad must also reconfigure the curvature of the lens to the final radius of curvature, requiring the removal of considerable material using a fine grit, particularly on the peripheral area of the lens. Removal of material is slower when accomplished by a fine pad versus a coarse pad. Now that the lens has been formed to the proper curvature, the polishing pad for the final polishing cannot be added on top of the other two grinding pads. The grinding pads must be removed from the lapping tool, the lapping tool cleaned, and a polishing pad of the appropriate thickness (the sum of the coarse and the fine grinding pads) must be attached to the lapping tool.

Considerable operating time is lost using the fining pad to re-conform the radius of curvature of the lens. Time is also lost during removal of the two grinding pads with the attached adhesive and during cleaning of the tool and application of new adhesive and the polishing pad. In addition, the pads having adhesive thereon are difficult to reuse as the adhesive on the pads may stick to itself damaging the pads.

It is clear then, that a method and apparatus are needed that will provide a means for reusing the grinding and polishing pads and which will reduce the time required for grinding the blanks to the final radius of curvature.

SUMMARY OF THE INVENTION

The present invention relates to a lens surfacing assembly of the type primarily intended for use with a rigid lapping tool having a preformed arcuate surface, and the method for using the same to grind and polish optical lenses. The assembly comprises a first part, an adhesive member, that further comprises a first surface and an opposed second surface, and a strippable cover attached to each surface of the adhesive member. When the strippable cover is removed from the first surface of the adhesive member, the adhesive member is adapted for removable attachment to the arcuate surface of a lapping tool.

The second part of the lens surfacing assembly, a lens surfacing pad, comprises a first roughened surface and an opposed second roughened surface. After removal of the strippable cover from the second surface of the adhesive member, the pad may be removably attached to the adhesive member, and thus, to the arcuate surface of the lapping tool. After use of one side of the lens surfacing pad, the pad may be removed, leaving the adhesive member attached to the lapping tool, flipped and re-attachable to the adhesive member exposing the other side of the pad for use.

A third part of the lens surfacing assembly comprises a lens polishing cloth. The cloth is attached to the adhesive member after removal of the lens surfacing pad.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
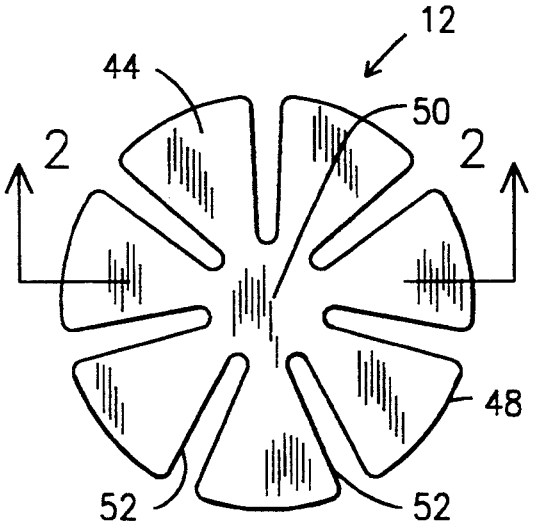
FIG. 1 is a plan view of the second part, a lens surfacing pad, of a preferred embodiment of this invention.
Figure 3:
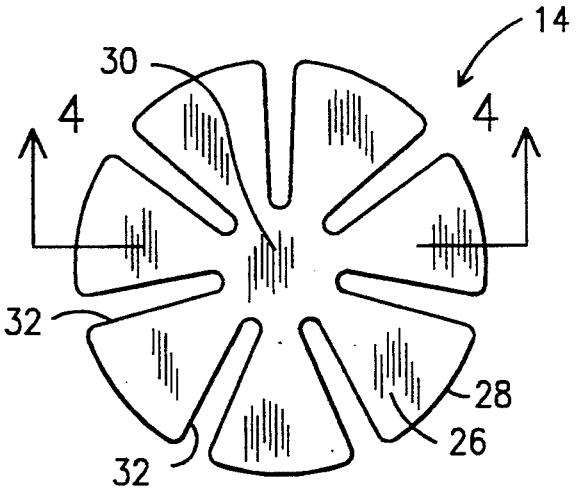
FIG. 3 is a plan view of the first part, an adhesive member, of a preferred embodiment of this invention.
Figure 2:
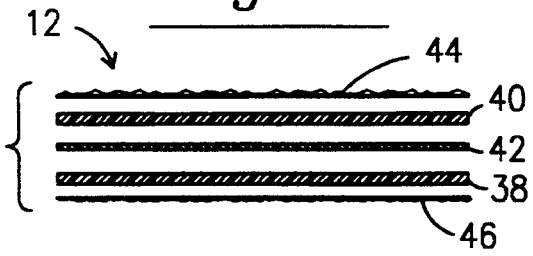
FIG. 2 is an exploded cross sectional view of the lens surfacing pad taken along line 2—2 of FIG. 1, illustrating the layers of material that comprise this part of the invention.
Figure 4:
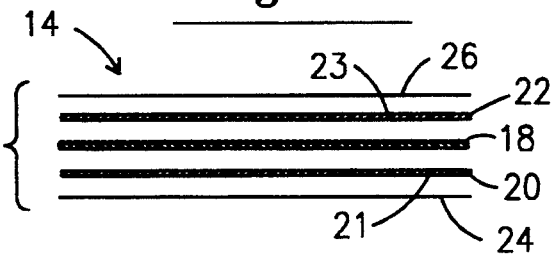
FIG. 4 is an exploded cross sectional view of the adhesive member taken along line 4—4 of FIG. 3, illustrating the layers of material comprising this part of the invention.
Figure 5:
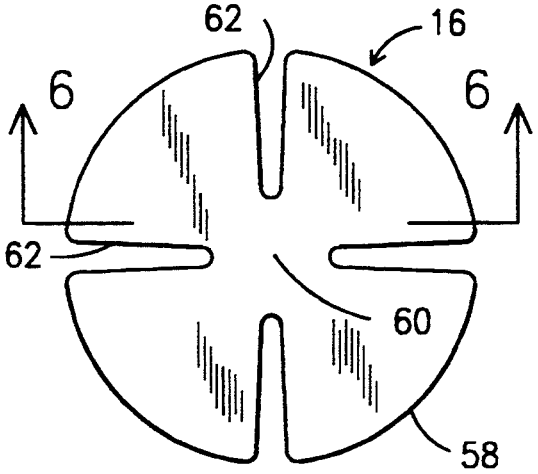
FIG. 5 is a plan view of a third part, a polishing cloth, of a preferred embodiment of this invention.
Figure 6:
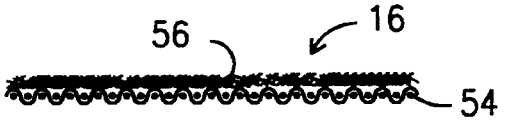
FIG. 6 is a cross sectional view along line 6—6 of FIG.. 5.
Figure 7:
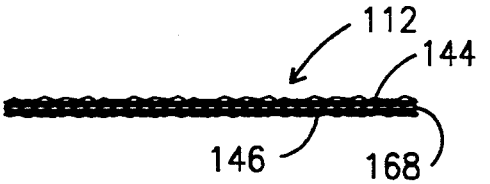
FIG. 7 is a cross sectional view of a second embodiment of the lens surfacing pad of this invention.
Figure 11:
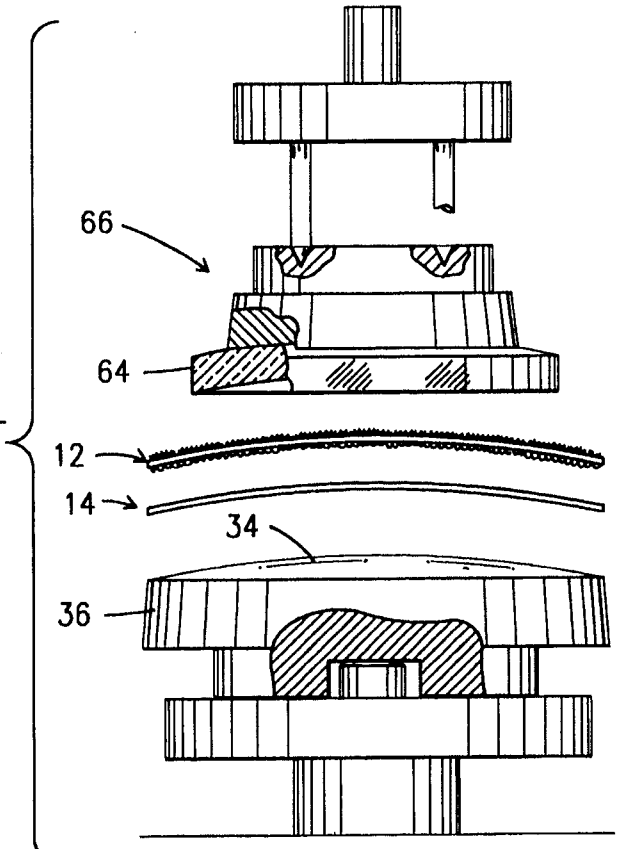
FIG. 11 is a side elevational view of a lens surfacing machine having a lapping tool mounted therein and illustrating in an exploded view the adhesive layer and the lens surfacing pad of this invention.

A preferred embodiment for the lens surfacing assembly of this invention is illustrated in the drawing FIGS. 1–6 and 8–11 in which the three parts of the lens surfacing assembly are indicated as 12, 14 and 16. FIGS. 1 and 2 illustrate the construction of a lens surfacing pad generally indicated as 12; FIGS. 3 and 4 illustrate the construction of an adhesive member, generally indicated as 14; and FIGS. 5 and 6 illustrate the construction of a polishing cloth, generally indicated as 16. FIG. 7 illustrates a second embodiment of the lens surfacing pad of FIG. 1 and is indicated generally as 112. This embodiment utilizes reference numbers increased by an increment of 100 for elements similar to the elements of FIGS. 1–6.

In a preferred embodiment, the adhesive member 14 is comprised of a fabric carrier 18 having two sides. On one side is attached a first layer of adhesive 20, and on the opposing side is attached a second layer of adhesive 22. The first layer of adhesive 20 further comprises an outwardly facing surface 21, and the second layer of adhesive 22 further comprises an outwardly facing surface 23. A first strippable cover 24 is removably attached to the surface 21 of the first layer of adhesive 20, and a second strippable cover 26 is removably attached to the surface 23 of the second layer of adhesive 22. Adhesive member 14 has an outer edge 28 and a central portion 30. A plurality of slots 32 extend radially outwardly from the central portion 30 to the outer edge 28 so that the adhesive member 14 may conform smoothly to the arcuate surface 34 of the lapping tool 36 shown in FIGS. 8–11. The first layer of adhesive 20 and the second layer of adhesive 22 each have different adhesive characteristics as they perform different functions in the operation of the lens surfacing assembly. The first layer of adhesive 20 is comprised of an adhesive having high tack and high shear characteristics. The higher the tack strength, the more difficult it is to strip the adhesive layer 20 from the arcuate surface 34, to which the adhesive layer 20 will be removably attached. The higher the shear strength the greater the resistance of the adhesive layer 20 to lateral movement in relation to the arcuate surface 34. The second layer of adhesive 22 has a lower tack strength than adhesive layer 20, so that a material attached to the adhesive layer 22, such as a lens surfacing pad 12, may be stripped from the adhesive layer 22 without stripping the first layer of adhesive 20 from the lapping tool 36. The second layer of adhesive 22 has a high shear strength to resist lateral movement of the attached pad 12.

In the above described embodiment, the adhesive layers 20 and 22 are comprised of rubber based adhesives. Rubber based adhesives having different tack strengths are well known in the art. Other adhesives suitable for the purpose with variable tack strengths are well known and also may be used. Any adhesive used must be appropriately operative while wet. By applying the adhesives to a fabric carrier, the tack strength of the adhesive is reduced by the amount of texture that is reflected in the surface of the adhesive layer from the texture of the fabric.

In other embodiments, the carrier 18 may be constructed from a non-woven fabric made from cloth fibers. Such fabrics are well known in the art.

In the preferred embodiment, the lens surfacing pad 12, shown in FIG. 1, is comprised of two substrates 38 and 40 which are attached to one another by bonding layer 42, which may comprise any of a number of well known adhesives that maintain a strong non-strippable bond. A roughened surface 44 is bonded to the outer surface of the substrate 40 of the laminated unit of substrates 40 and 38. In a preferred embodiment, the roughened surface 44 comprises a coarse layer of silicon carbide with a grit between 600 and 800. The substrate 40 will normally be a paper substrate and the grit will be bonded to it by the manufacturer utilizing their standard process. In a preferred embodiment, the substrate 38 is comprised of a resin film to which a fining layer of abrasive 46, normally aluminum oxide with a grit size from 3 to 12 microns is again bonded to the substrate 38 by the manufacturer utilizing their normal processes. In the alternative, other grit material and grit sizes may be used successfully. Other well known forms of abrading material, such as other minerals or metals, may be used instead of grit type materials with satisfactory results.

The lens surfacing pad 12 has an outer edge 48 and a central portion 50. A plurality of slits 52 extend radially outwardly from the central portion of the pad 50 to the outer edge 48 of the pad 12.

In a preferred embodiment, the lens surfacing assembly is provided in three components. The first part being the adhesive layer 14, the second part being the lens surfacing pad 12, and the third part a polishing cloth 16. However, an alternative would be to provide the first adhesive and second surfacing pad parts removably attached to one another and ready to install on a lapping tool 36 with the coarse side 44 exposed. This would reduce the number of parts to be provided and eliminate strippable cover 26.

In a second embodiment of the lens surfacing pad, as shown in FIG. 7, the pad 112 may be comprised of a single paper or resin substrate 168 to which is bonded on one side the layer of coarse abrasive 144 and on the other side the layer of finer abrasive 146. It is to be remembered that the lens surfacing pads 12 or 112 must operate in a wet environment, and to make the pads longer lived the more stable substrate should be selected.

FIGS. 5 and 6 disclose a third part of the lens surfacing assembly,the polishing cloth 16, which comprises a fabric 54 having a nap 56 on one side. The appropriate abrasives used in the industry for the final polishing are applied to the nap 56 of the cloth 16, usually in slurry form. The polishing cloth 16 has an outer edge 58, a central portion 60 and a plurality of gaps 62 that extend radially outwardly from the central portion 60 to the outer edge 50. In a preferred embodiment, four gaps 62 are provided; however, a varying number may be selected, depending upon the curvature of the arcuate surface 34 and the stiffness of the fabric 54, to ensure that the cloth 16 conforms to the arcuate surface 34 of the lapping tool 36.

The standard compensation for lapping tools comprises a total of 0.018 of an inch. Therefore, the combined total of the adhesive member 14 (generally 0.006 to 0.008 inches thick) and the lens surfacing pad 12 (generally 0.010 to 0.012 inches thick) must equal 0.018 of an inch. The polishing cloth 16 and the adhesive member 14 must also have a combined thickness of 0.018 of an inch. Therefore, the polishing cloth must comprise a compressed thickness of 0.010 to 0.012 of an inch. The key requirement is that the total thickness must be equal to the compensation designed into the lapping tools. If the lapping tool compensation is changed, the thickness of the parts of the invention must also change so that the radius of curvature of the tool, plus the adhesive member thickness, plus the surfacing pad thickness, equals the desired radius of curvature of the lens.

Having thus set forth a preferred construction for the lens surfacing assembly 10 of this invention, it is to be remembered that this is but a preferred embodiment.

Attention is now invited to a description of the method of use for one embodiment of the lens surfacing assembly 10. In sophisticated optical labs, the laboratory may be divided into a number of different rooms to separate the various activities, particularly the dirtier activities, from the other areas or departments. A laboratory may be divided into a stock room, tool room, layout room, generator room, lab department, fining department and polishing department. In a typical optical lab, the work is moved in a job tray from one station to the other with an order defining the particular lens that is required to be ground and polished.

Lapping tools are designed with an arcuate surface whose radius of curvature has been reduced to compensate for the added thickness of the lens surfacing pads, i.e. the thickness of the coarse and fine pads. In this invention, the combined thickness of the lens surfacing pad 12 and the adhesive member 14 equals 0.018 of an inch, equalling the standard lapping tool compensation currently used in the industry.

Figure 8:
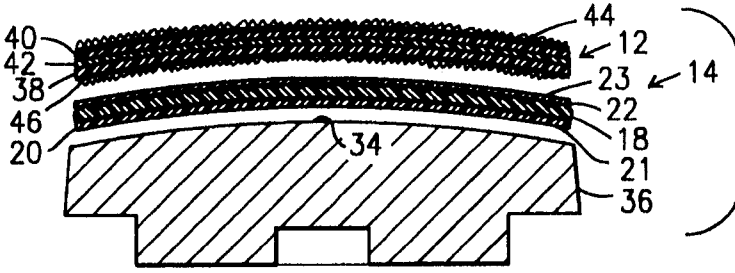
FIG. 8 is an exploded cross sectional view of a preferred embodiment of the invention attached to a lapping tool illustrating the adhesive layer and the lens surfacing pad.
Figure 9:
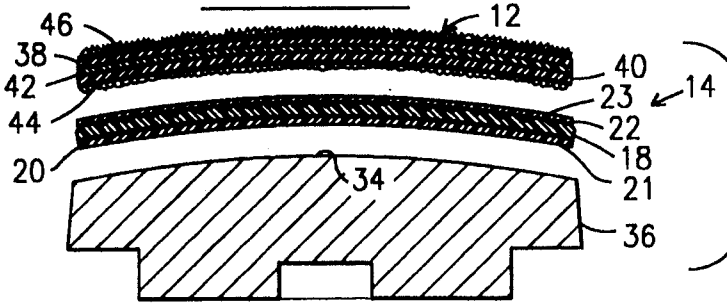
FIG. 9 is the exploded cross sectional view of the embodiment of the invention shown in FIG. 8 illustrating the flipping of the lens surfacing pad.
Figure 10:
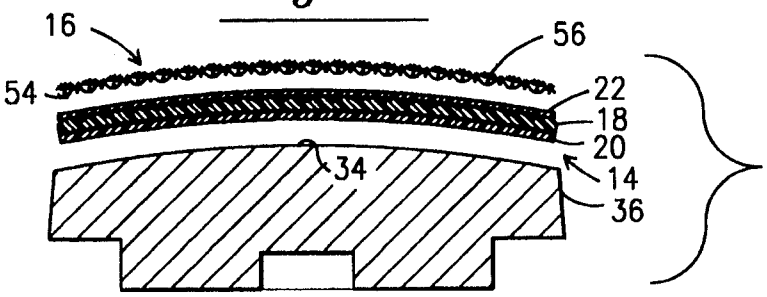
FIG. 10 is a cross sectional view of the adhesive layer and polishing cloth of this invention attached to a lapping tool.

In the current invention, the appropriate lapping tool is selected to meet the curvature that has been ordered and the appropriate lens surfacing pad and layer of adhesive are selected to provide a total of 0.018 of an inch in thickness. As shown in FIG. 8, first cover 24 is removed from the adhesive member 14, and the adhesive member 14 is applied to the arcuate surface 34 of the lapping tool 36. The second cover 26 is then removed so that the fining layer 46 of the lens surfacing pad 12 may be applied to the adhesive layer 22, ensuring that the slits 52 of the lens surfacing pad 12 are aligned with and overlie the slots 32 of the adhesive layer 14. The lapping tool is then mounted in the lens grinding machine, shown generally as 66 in FIG. 11. The lens blank 64 is now ground by the roughened surface 44 until the proper radius of curvature is attained. As the radius of curvature of the lapping tool 36 plus the thickness of the lens surfacing pad 12 and the adhesive member 14 equals the final radius of curvature, the lens blank 64 is now formed to the final radius of curvature desired.

When the coarse grinding is completed, the lens surfacing pad 12 is removed from adhesive layer 22, flipped over and reapplied to the adhesive layer 22 with the fining layer 46 now exposed. The fining operation is continued until a smooth surface is obtained. As less material must be removed from the lens blank 64 during the grinding and fining operations, the finishing of the lens blank 64 is done much more quickly than as previously done in the prior art.

The lens surfacing pad 12 is now stripped from the adhesive layer 22 and a polishing cloth 16, having a thickness that added to the thickness of the adhesive member 14 equals 0.018 of an inch, is now attached to the adhesive layer 22. A fine slurry of polishing compound is added to the polishing cloth to provide the desired surface quality for the lens. Upon completion of the polishing cycle, the polishing cloth 16 is removed and may be stored for future use. In the prior art, most polishing cloths have the adhesive attached directly to the polishing cloth resulting in the polishing cloth sticking to itself and becoming unusable after the first use.

In the current invention, the lapping tool 36 is now returned to the tool room for cleaning and storage for future use.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A lens surfacing assembly adapted for use with a rigid lapping tool having an arcuate surface, said assembly comprising:

a first part comprising an adhesive member having a first adhesive surface and an opposed second adhesive surface and said first part further comprising a first strippable cover and a second strippable cover attached to a respective said first and said second adhesive surface, said first adhesive surface, with said first cover removed, being adapted for removable attachment to an arcuate surface of a lapping tool; and a second part comprising a lens surfacing pad having a first abrasive coated surface and an opposed second abrasive coated surface, said pad being removably attachable to said second adhesive surface after removal of said second cover from said second adhesive surface.

2. A lens surfacing assembly as in claim 1 wherein said assembly further comprises a third part that is removably attachable to said second adhesive surface of said adhesive member when said lens surfacing pad is not attached thereto, said third part comprising a polishing cloth having a first cloth surface and an opposed second cloth surface, said second cloth surface being removably attachable to said second adhesive surface.

3. A lens surfacing assembly as in claim 1 wherein said second adhesive surface is textured.

4. A lens surfacing assembly as in claim 1 wherein said attachment of said first surface of said adhesive member to said lapping tool is stronger than said attachment of said second surface of said adhesive member to said pad, such that when said pad is removed from said second adhesive surface said adhesive member remains attached to the lapping tool.

5. A lens surfacing assembly as in claim 1 wherein said first roughened surface of said pad is coarser than said second roughened surface of said pad.

6. A lens surfacing assembly as in claim 1 wherein said pad further comprises an outer edge, a central portion, and a plurality of slits extending radially outwardly from said central portion of said pad to said outer edge so that said pad is adapted to conform to the arcuate surface of the lapping tool.

7. A lens surfacing assembly as in claim 6 wherein said adhesive member comprises an outer edge, a central portion, and a plurality of slots extending radially outwardly from said central portion to said outer edge, said outer edge and said slots of said adhesive member generally conforming to said outer edge and to said slits of said pad such that when said pad is attached to said adhesive member said outer edge of said pad and said slits are generally coincident with said outer edge and slots of said adhesive member.

8. A lens surfacing assembly adapted for use with a rigid lapping tool having an arcuate surface, said assembly comprising:

a lens surfacing pad having a first abrasive coated surface and an opposed second abrasive coated surface, an adhesive member having a first adhesive surface and an opposed second adhesive surface, said second adhesive surface of said adhesive member being removably attached to said pad; and a strippable cover attached to said first adhesive surface.

9. A lens surfacing assembly as in claim 8 wherein when said first adhesive surface of adhesive member is attached to a lapping tool, said attachment of said first adhesive surface of said adhesive member to the lapping tool is stronger than said attachment of said second adhesive surface of said adhesive member to said pad, such that when said pad is removed from said adhesive member said adhesive member remains attached to the lapping tool.

10. A lens surfacing assembly as in claim 8 wherein said first roughened surface of said pad is coarser than said second toughened surface of said pad.

11. A lens surfacing assembly as in claim 8 wherein said second adhesive surface is textured.

12. A lens surfacing assembly as in claim 8 wherein said pad further comprises an outer edge and a central portion, and a plurality of slits extending radially outwardly from said central portion of said pad to said outer edge so that said pad conforms smoothly to the arcuate surface of said lapping tool.

13. A lens surfacing assembly as in claim 12 wherein said adhesive member comprises an outer edge, a central portion, and a plurality of slots extending radially outwardly from said central portion to said outer edge, said outer edge and said slots of said adhesive member generally conforming to said outer edge and said slits of said pad such that when said pad is attached to said adhesive member, said outer edge of said pad and said slits are generally coincident with said outer edge and slots of said adhesive member.

14. A method for grinding, fining and polishing lens blanks, said method for use with a typical lens grinding machine and a rigid lapping tool, comprising the steps of:

attaching a first adhesive surface of an adhesive member to an arcuate surface of lapping tool, said lapping tool being mounted within said lens grinding machine, said adhesive member having an opposed second adhesive surface;

attaching a lens surfacing pad to said second adhesive surface of said adhesive member, said lens surfacing pad having a first abrasive coated surface and an opposed second abrasive coated surface, said first abrasive coated surface of said pad being coarser than said second surface of said pad, said second abrasive coated surface of said pad being removably attached to said second adhesive surface of said adhesive member;

grinding a lens blank with said first abrasive coated surface of said lens surfacing pad to a predetermined curvature;

removing said surfacing pad from said adhesive member, such that said adhesive member remains attached to said lapping tool;

attaching said first abrasive coated surface of said lens surfacing pad to said adhesive member, whereby said lens surfacing pad is attached to said lapping tool; and fining said lens blank, with said second abrasive coated surface of said lens surfacing pad, to a predetermined curvature.

15. A method for polishing lenses as in claim 14 comprising the further steps, after fining said lens blank, of:

removing said surfacing pad from said adhesive member such that said adhesive member remains attached to said lapping tool;

attaching a polishing cloth to said adhesive member, thereby attaching said polishing cloth to said lapping tool;

applying polishing compound to said polishing cloth; and polishing said lens blank with said polishing cloth and compound.

16. A lens surfacing assembly as in claim 1 wherein said first adhesive surface has a tack strength greater than said second adhesive surface, whereby when said first adhesive surface of said member is attached to the lapping tool, said attachment to said lapping tool is stronger than said attachment of said pad to said second adhesive surface of said adhesive member, and when said pad is removed from said adhesive member, said adhesive member remains attached to the lapping tool.

17. A lens surfacing assembly adapted for use with a rigid lapping tool having an arcuate surface, said assembly comprising:

a first part comprising an adhesive member having a first adhesive surface and an opposed second adhesive surface, said first adhesive surface having a tack strength greater than said second adhesive surface, said first part further comprising a first and a second strippable cover attached to a respective said first and said second adhesive surface, said first adhesive surface, with said first cover removed, being adapted for removable attachment to an arcuate surface of a lapping tool; and a second part comprising a lens surfacing pad having a first abrasive coated surface and an opposed second abrasive coated surface, said pad being removably attachable to said second adhesive surface after removal of said second cover from said second adhesive surface, whereby when said pad is removed from said second adhesive surface said adhesive member remains attached to the lapping tool.

18. A lens surfacing assembly as in claim 17 wherein said second adhesive surface is textured.

19. A lens surfacing assembly as in claim 17 wherein said first abrasive coated surface of said pad is coarser than said second abrasive coated surface of said pad.

20. A lens surfacing assembly as in claim 17 wherein said pad further comprises an outer edge, a central portion, and a plurality of slits extending radially outwardly from said central portion of said pad to said outer edge so that said pad is adapted to conform to the arcuate surface of the lapping tool.

21. A lens surfacing assembly as in claim 20 wherein said adhesive member comprises an outer edge, a central portion, and a plurality of slots extending radially outwardly from said central portion to said outer edge, said outer edge and said slots of said adhesive member generally conforming to said outer edge and to said slits of said pad such that when said pad is attached to said adhesive member said outer edge of said pad and said slits are generally coincident with said outer edge and slots of said adhesive member.

22. A lens surfacing assembly adapted for use with a rigid lapping tool having an arcuate surface, said assembly comprising:

an adhesive member having a first adhesive surface and an opposed second adhesive surface, said first adhesive surface having a tack strength greater than said second adhesive surface:

a strippable cover attached to said first surface of said adhesive member; and a lens surfacing pad having a first abrasive coated surface and an opposed second abrasive coated surface, said pad being removably attached to said second adhesive surface, said first adhesive surface, with said cover removed, being adapted for removable attachment to an arcuate surface of a lapping tool, whereby when said first adhesive surface of said member is attached to the lapping tool, said attachment to said lapping tool is stronger than said attachment of said pad to said second adhesive surface of said adhesive member, such that when said pad is removed from said adhesive member, said adhesive member remains attached to the lapping tool.

23. A lens surfacing assembly as in claim 22 wherein said first abrasive coated surface of said pad is coarser than said second abrasive coated surface of said pad.

24. A lens surfacing assembly as in claim 22 wherein said second adhesive surface is textured.

25. A lens surfacing assembly as in claim 22 wherein said pad further comprises an outer edge and a central portion, and a plurality of slits extending radially outwardly from said central portion of said pad to said outer edge so that said pad conforms smoothly to the arcuate surface of said lapping tool.

26. A lens surfacing assembly as in claim 25 wherein said adhesive member comprises an outer edge, a central portion, and a plurality of slots extending radially outwardly from said central portion to said outer edge, said outer edge and said slots of said adhesive member generally conforming to said outer edge and to said slits of said pad such that when said pad is attached to said adhesive member said outer edge of said pad and said slits are generally coincident with said outer edge and slots of said adhesive member.

* * * * *

UNITED STATES PATENT AND TRADEMARK OFFICE

CERTIFICATE OF CORRECTION

PATENT NO. : 5,384,988

DATED : January 31, 1995

INVENTOR(S) : William D. Hernandez

It is certified that error appears in the above-identified patent and that said Letters Patent is hereby corrected as shown below:

Column 7, line 60, delete "toughened", and insert therefore, --roughened--.

Column 8, line 16, after "of" insert --a--.

Signed and Sealed this

Eleventh Day of April, 1995

*Attest:*

*Attesting Officer*

BRUCE LEHMAN

*Commissioner of Patents and Trademarks*